US007051744B2

(12) United States Patent
Hung

(10) Patent No.: US 7,051,744 B2
(45) Date of Patent: May 30, 2006

(54) SUNSHADE STRUCTURE OPERATED EASILY

(76) Inventor: Hsi-Lu Hung, No., 202, Huei Nan Rd., Her Mei Town, Changhua Hsien (TW)

( * ) Notice: Subject to any disclaimer, the term of this patent is extended or adjusted under 35 U.S.C. 154(b) by 114 days.

(21) Appl. No.: 10/823,122

(22) Filed: Apr. 12, 2004

(65) Prior Publication Data

US 2005/0247332 A1 Nov. 10, 2005

(51) Int. Cl.
*A45B 25/00* (2006.01)

(52) U.S. Cl. ..... 135/20.3; 135/22

(58) Field of Classification Search ..... 135/20.3, 135/22

See application file for complete search history.

(56) References Cited

U.S. PATENT DOCUMENTS

| | | | | | |
|---|---|---|---|---|---|
| 2,745,421 | A * | 5/1956 | Russell | 135/38 |
| 2,960,094 | A * | 11/1960 | Small | 135/22 |
| 3,801,809 | A * | 4/1974 | Slade | 362/134 |
| 4,011,881 | A * | 3/1977 | Becher | 135/20.3 |
| 4,424,824 | A * | 1/1984 | Becher | 135/20.3 |
| 5,740,822 | A * | 4/1998 | Einck | 135/16 |
| 5,937,882 | A * | 8/1999 | Harbaugh | 135/20.3 |
| 6,058,951 | A * | 5/2000 | Wilson | 135/20.3 |
| 6,129,101 | A * | 10/2000 | Dubinsky | 135/20.3 |
| 2004/0040591 | A1 * | 3/2004 | Ma | 135/908 |
| 2005/0016571 | A1 * | 1/2005 | Wu | 135/20.1 |
| 2005/0133077 | A1 * | 6/2005 | Zerillo | 135/20.3 |

* cited by examiner

*Primary Examiner*—Robert Canfield
(74) *Attorney, Agent, or Firm*—Alan D. Kamrath; Nikolai & Mersereau, P.A.

(57) ABSTRACT

A sunshade structure includes an upright rod, a drive motor, a drive shaft, a pulley, a slide, a skeleton, a lift cord, and a control device. In practice, the control switch of the control device is pushed to start the drive motor to operate the sunshade structure, so that the sunshade structure is expanded or collapsed automatically in a wire manner. Alternatively, the wireless receiver of the control device receives a signal from a remote controller to start the drive motor to operate the sunshade structure, so that the sunshade structure is expanded or collapsed automatically in a wireless manner. Thus, the sunshade structure is expanded or collapsed automatically without needing a manual work, thereby saving the user's energy.

8 Claims, 2 Drawing Sheets

SUNSHADE STRUCTURE OPERATED EASILY

BACKGROUND OF THE INVENTION

1. Field of the Invention

The present invention relates to a sunshade structure, and more particularly to a sunshade structure that is operated easily and conveniently to facilitate a user operating the sunshade structure, thereby saving the manual work and energy.

2. Description of the Related Art

A conventional sunshade structure used outdoors comprises an upright rod, a skeleton pivotally mounted on the upright rod, and a canopy mounted on the upright rod and rested on the skeleton. However, the skeleton usually has a larger volume with a heavier weight, so that a user needs to exert a larger force to drive the skeleton to move on the upright rod to expand or collapse the canopy so as to expand or collapse the conventional sunshade structure, thereby wasting the manual work and energy.

SUMMARY OF THE INVENTION

The primary objective of the present invention is to provide a sunshade structure that is operated easily and conveniently to facilitate a user operating the sunshade structure, thereby saving the manual work and energy.

Another objective of the present invention is to provide a sunshade structure that is expanded or collapsed automatically without needing a manual work, thereby saving the user's energy.

A further objective of the present invention is to provide a sunshade structure, wherein the control switch of the control device is pushed by a user to start the drive motor to expand or collapse the sunshade structure, so that the sunshade structure is expanded or collapsed automatically in a wire manner.

A further objective of the present invention is to provide a sunshade structure, wherein the wireless receiver of the control device receives a signal from a remote controller to start the drive motor to expand or collapse the sunshade structure, so that the sunshade structure is expanded or collapsed automatically in a wireless manner.

In accordance with the present invention, there is provided a sunshade structure, comprising:

a hollow upright rod;

a drive motor mounted on a first end of the upright rod;

a drive shaft rotatably mounted in the first end of the upright rod and having a distal end connected to and rotated by the drive motor;

a pulley mounted in a second end of the upright rod;

a slide slidably mounted on a mediate portion of the upright rod;

a skeleton having a first portion pivotally mounted on the second end of the upright rod and a second portion pivotally mounted on the slide to move therewith;

a lift cord mounted on the pulley and having a first end wound around the drive shaft to move therewith and a second end secured on the slide to move the slide; and a control device electrically connected to the drive motor to operate the drive motor to rotate the drive shaft.

Further benefits and advantages of the present invention will become apparent after a careful reading of the detailed description with appropriate reference to the accompanying drawings.

DETAILED DESCRIPTION OF THE INVENTION

Figure 1:
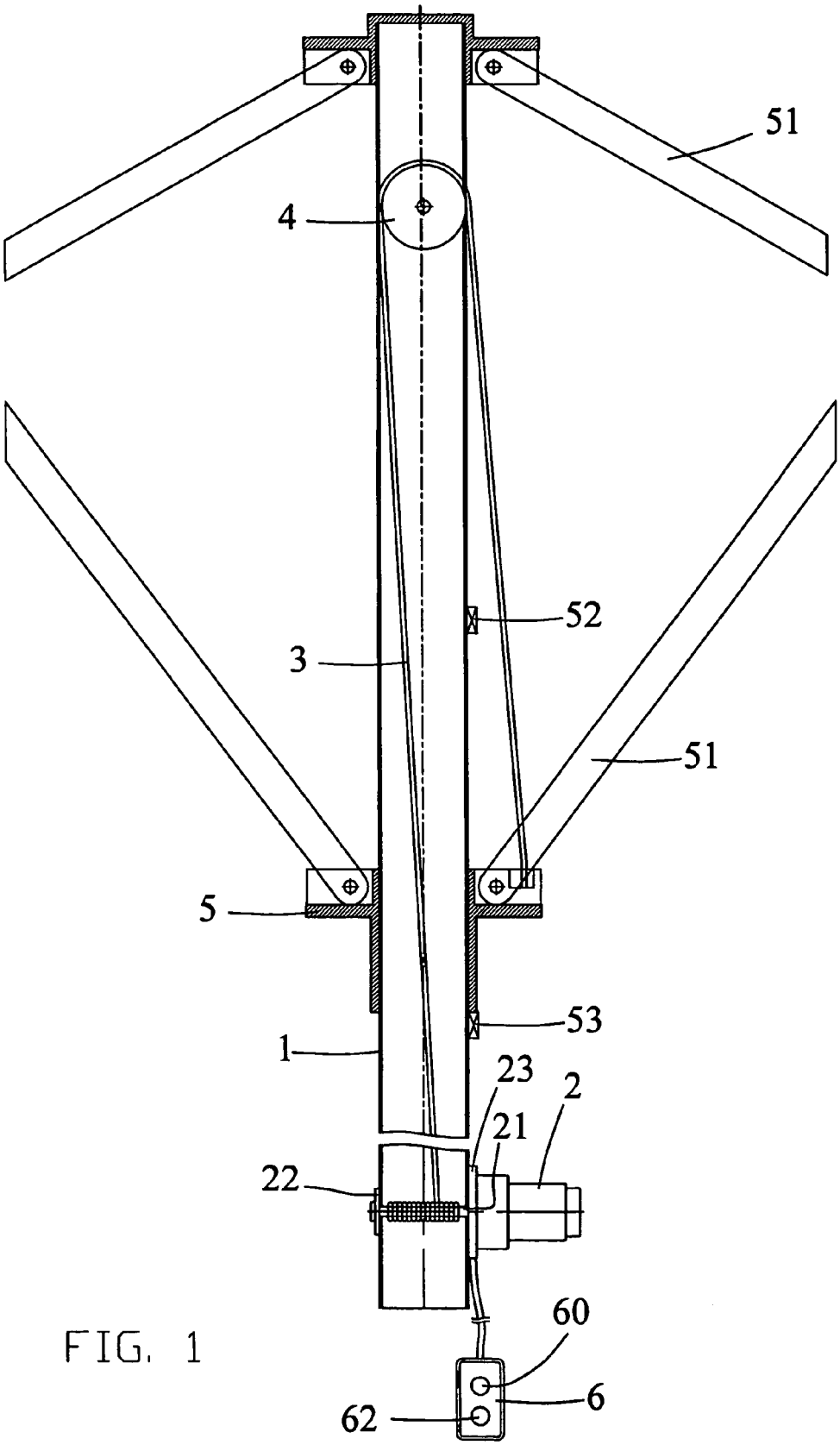
FIG. 1 is a partially cut-away plan cross-sectional assembly view of a sunshade structure in accordance with the preferred embodiment of the present invention.

Referring to the drawings and initially to FIG. 1, a sunshade structure in accordance with the preferred embodiment of the present invention comprises a hollow upright rod 1, a direct current drive motor 2 mounted on a first end of the upright rod 1, a drive shaft 21 rotatably mounted in the first end of the upright rod 1 and having a distal end connected to and rotated by the drive motor 2, a pulley 4 mounted in a second end of the upright rod 1, a slide 5 slidably mounted on a mediate portion of the upright rod 1, a skeleton 51 having a first portion pivotally mounted on the second end of the upright rod 1 and a second portion pivotally mounted on the slide 5 to move therewith, a lift cord 3 mounted on the pulley 4 and having a first end wound around the drive shaft 21 to move therewith and a second end secured on the slide 5 to move the slide 5, and a control device 6 electrically connected to the drive motor 2 to operate the drive motor 2 to rotate the drive shaft 21.

Preferably, the drive shaft 21 is transversely extended through the first end of the upright rod 1 and is supported by a bearing plate 22 and a fixing plate 23. The fixing plate 23 is located between the drive motor 2 and the upright rod 1. The control device 6 is provided with a control switch 60 and a wireless receiver 62. The lift cord 3 is received in the upright rod 1 and the second end of the lift cord 3 is extended outward from the upright rod 1. The slide 5 has a substantially T-shaped cross section.

Figure 2:
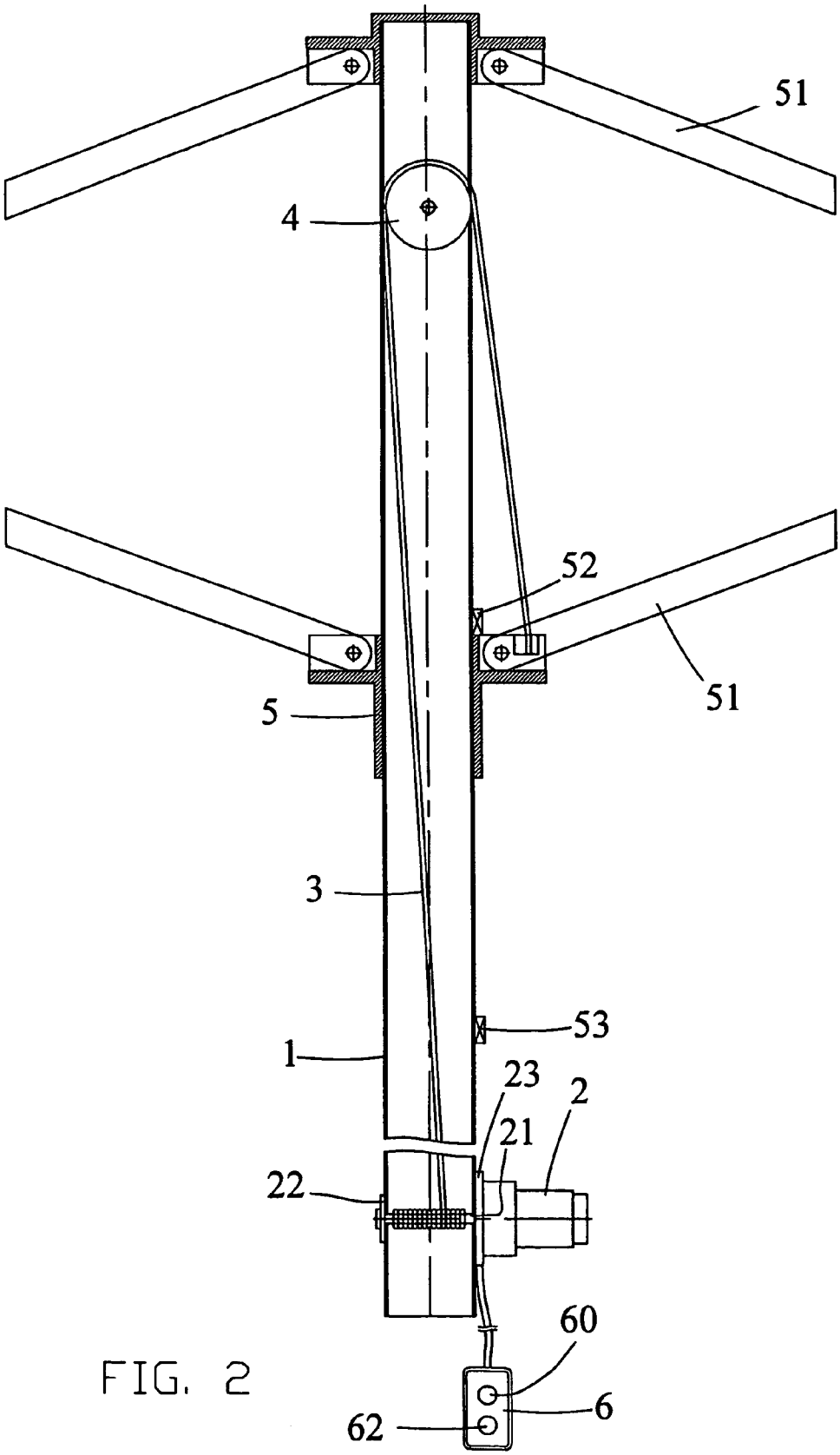
FIG. 2 is a schematic operational view of the sunshade structure as shown in FIG. 1.

The sunshade structure further comprises a first microswitch 52 mounted on the upright rod 1 and electrically connected to the drive motor 2 and the control device 6, and a second microswitch 53 mounted on the upright rod 1 and electrically connected to the drive motor 2 and the control device 6, wherein the slide 5 is limited to move on the upright rod 1 between the first microswitch 52 and the second microswitch 53 as shown in FIGS. 1 and 2.

In operation, the drive motor 2 is operated by the control device 6 to rotate the drive shaft 21 to wind or unwind the lift cord 3 to drive the slide 5 to move upward or downward to lift or lower the skeleton 51 so as to expand or collapse the sunshade structure.

As shown in FIG. 1, the drive motor 2 is operated by the control device 6 to rotate the drive shaft 21 to unwind and loosen the lift cord 3 to drive the slide 5 to move downward to lower the skeleton 51 so as to collapse the sunshade structure. When the slide 5 reaches the second microswitch 53 as shown in FIG. 1, the second microswitch 53 sends a signal to the control device 6 to stop operation of the drive motor 2.

As shown in FIG. 2, the drive motor 2 is operated by the control device 6 to rotate the drive shaft 21 to wind and tighten the lift cord 3 to drive the slide 5 to move upward to lift the skeleton 51 so as to expand the sunshade structure. When the slide 5 reaches the first microswitch 52 as shown in FIG. 2, the first microswitch 52 sends a signal to the control device 6 to stop operation of the drive motor 2.

In practice, the control switch 60 of the control device 6 is pushed by a user to start the drive motor 2 to expand or collapse the sunshade structure, so that the sunshade structure is expanded or collapsed automatically in a wire manner.

Alternatively, the wireless receiver 62 of the control device 6 receives a signal from a remote controller (not shown) to start the drive motor 2 to expand or collapse the sunshade structure, so that the sunshade structure is expanded or collapsed automatically in a wireless manner.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sunshade structure, comprising:

a hollow upright rod;

a drive motor mounted on a first end of the upright rod;

a drive shaft rotatably mounted in the first end of the upright rod and having a distal end connected to and rotated by the drive motor;

a pulley mounted in a second end of the upright rod;

a slide slidably mounted on a mediate portion of the upright rod;

a skeleton having a first portion pivotally mounted on the second end of the upright rod and a second portion pivotally mounted on the slide to move therewith;

a lift cord mounted on the pulley and having a first end wound around the drive shaft to move therewith and a second end secured on the slide to move the slide;

a control device electrically connected to the drive motor to operate the drive motor to rotate the drive shaft;

a first microswitch mounted on the upright rod and electrically connected to the drive motor and the control device; and a second microswitch mounted on the upright rod and electrically connected to the drive motor and the control device;

wherein, the slide is limited to move between the first microswitch and the second microswitch.

2. The sunshade structure in accordance with claim 1, wherein the drive motor is a direct current motor.

3. The sunshade structure in accordance with claim 1, wherein the drive shaft is transversely extended through the first end of the upright rod.

4. The sunshade structure in accordance with claim 1, wherein the drive shaft is supported by a bearing plate and a fixing plate.

5. The sunshade structure in accordance with claim 4, wherein the fixing plate is located between the drive motor and the upright rod.

6. The sunshade structure in accordance with claim 1, wherein the control device is provided with a control switch and a wireless receiver.

7. The sunshade structure in accordance with claim 1, wherein the lift cord is received in the upright rod and the second end of the lift cord is extended outward from the upright rod.

8. The sunshade structure in accordance with claim 1, wherein the slide has a substantially T-shaped cross section.

* * * * *